US010151035B2

(12) United States Patent
Naab

(10) Patent No.: US 10,151,035 B2
(45) Date of Patent: Dec. 11, 2018

(54) ELECTROLESS METALLIZATION OF THROUGH-HOLES AND VIAS OF SUBSTRATES WITH TIN-FREE IONIC SILVER CONTAINING CATALYSTS

(71) Applicant: Rohm and Haas Electronic Materials LLC, Marlborough, MA (US)

(72) Inventor: Benjamin Naab, Framingham, MA (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 0 days.

(21) Appl. No.: 15/165,276

(22) Filed: May 26, 2016

(65) Prior Publication Data

US 2017/0342567 A1 Nov. 30, 2017

(51) Int. Cl.

| | |
|---|---|
| ***B05D 5/12*** | (2006.01) |
| ***C23C 18/42*** | (2006.01) |
| ***C23C 18/16*** | (2006.01) |
| ***C23C 18/18*** | (2006.01) |
| ***C23C 18/20*** | (2006.01) |
| ***C23C 18/30*** | (2006.01) |
| ***C23C 18/40*** | (2006.01) |

(52) U.S. Cl.

CPC ..... *C23C 18/42* (2013.01); *C23C 18/1608* (2013.01); *C23C 18/1635* (2013.01); *C23C 18/1893* (2013.01); *C23C 18/2086* (2013.01); *C23C 18/30* (2013.01); *C23C 18/40* (2013.01)

(58) Field of Classification Search

USPC ..... 427/97.2, 97.7

See application file for complete search history.

(56) References Cited

U.S. PATENT DOCUMENTS

| | | | | |
|---|---|---|---|---|
| 4,054,693 | A * | 10/1977 | Leech | H05K 3/381 252/79.1 |
| 5,112,513 | A * | 5/1992 | Bressel | H05K 3/381 216/35 |
| 5,194,313 | A * | 3/1993 | Hupe | C08G 61/123 205/112 |
| 5,300,208 | A | 4/1994 | Angelopoulos et al. | |
| 5,318,621 | A * | 6/1994 | Krulik | C23C 18/42 106/1.23 |
| 5,373,629 | A | 12/1994 | Hupe et al. | |
| 5,545,308 | A | 8/1996 | Murphy et al. | |
| 5,830,563 | A * | 11/1998 | Shimoto | H05K 3/465 428/209 |
| 5,919,402 | A | 7/1999 | Murphy et al. | |
| 6,210,537 | B1 | 4/2001 | Murphy et al. | |
| 6,334,965 | B1 | 1/2002 | Singh et al. | |
| 6,486,055 | B1 * | 11/2002 | Jung | H01L 21/288 257/E21.174 |
| 7,025,867 | B2 | 4/2006 | Czeczka et al. | |
| 8,499,446 | B2 * | 8/2013 | Nakai | H05K 3/108 174/250 |
| 9,149,798 | B2 | 10/2015 | Zhou et al. | |
| 9,353,443 | B2 | 5/2016 | Milum et al. | |
| 9,918,389 | B2 | 3/2018 | Liu et al. | |
| 2005/0227049 | A1 | 10/2005 | Boyack et al. | |
| 2009/0056994 | A1 * | 3/2009 | Kuhr | C23C 18/1653 174/259 |
| 2016/0333482 | A1 * | 11/2016 | Shukla | C23C 18/30 |
| 2017/0130354 | A1 | 5/2017 | Nishigawa et al. | |
| 2017/0166812 | A1 * | 6/2017 | Middeke | C25D 5/56 |

FOREIGN PATENT DOCUMENTS

| | | |
|---|---|---|
| JP | 2010159468 A | 7/2010 |
| WO | 2003033764 | 4/2003 |
| WO | 2013031846 | 3/2013 |
| WO | 2014106949 | 7/2014 |

OTHER PUBLICATIONS

V. W. L. Lim, et al., Electroless plating of palladium an dcopper on polypyrrole films, Synthetic Metals, 123 (2001) 107-115.

Search report for corresponding Europe Application No. 17 17 2806 dated Oct. 3, 2017.

Search report for corresponding Taiwan Application No. 106114370 dated Feb. 1, 2018.

* cited by examiner

*Primary Examiner* — Austin Murata

(74) *Attorney, Agent, or Firm* — John J. Piskorski

(57) ABSTRACT

Walls of through-holes and vias of substrates with dielectric material are electroless plated with copper using tin-free ionic silver catalysts. Conductive polymers are first formed on the substrates by treating the substrates with a permanganate solution containing complexing anions followed by applying monomers, oligomers or conductive polymers to the substrate to form a conductive polymer coating on the dielectric of the substrate as well as on the walls of through-holes and vias of the substrate. A tin-free ionic silver catalyst is then applied to the treated substrate. Optionally, the tin-free ionic silver catalyst can include a ligand agent to form a coordination entity with the silver ions of the tin-free catalyst. The silver ions of the tin-free catalyst are reduced by the conductive polymer and then an electroless metal copper bath is applied to the treated substrate to copper plate the dielectric and walls of the through-holes and vias of the substrate.

14 Claims, No Drawings

ELECTROLESS METALLIZATION OF THROUGH-HOLES AND VIAS OF SUBSTRATES WITH TIN-FREE IONIC SILVER CONTAINING CATALYSTS

FIELD OF THE INVENTION

The present invention is directed to electroless metallization of through-holes and vias of substrates with tin-free ionic silver containing catalysts. More specifically, the present invention is directed to electroless metallization of through-holes and vias of substrates with tin-free ionic silver containing catalysts to provide a uniform metal deposit on the substrate and inhibit immersion plating of silver.

BACKGROUND OF THE INVENTION

High density interconnect (HDI) printed circuit boards (PCBs) contain multiple layers of copper interconnects separated by insulating material that are united by metallized features such as through-holes and vias. The most common method for the metallization of the through-holes and vias is electroless copper. Most catalysts for electroless copper are based on either colloidal or ionic palladium. In the activation process, the palladium-based colloid is adsorbed onto an insulating substrate such as epoxy or polyimide to activate electroless copper deposition. Theoretically, for electroless metal deposition, the catalyst particles play roles as carriers in the path of transfer of electrons from reducing agent to metal ions in the plating bath. Although the performance of an electroless copper process is influenced by many factors such as composition of the plating solution and choice of ligand for copper, the activation step is the key factor for controlling the rate and mechanism of electroless metal deposition. Palladium/tin colloids have been commercially used as an activator for electroless metal deposition for decades, and its structure has been extensively studied. The colloid includes a metallic palladium core surrounded by a stabilizing layer of tin(II) ions. A shell of $[SnCl_3]^-$ complexes act as surface stabilizing groups to avoid agglomeration of colloids in suspension. Yet, its sensitivity to air and high cost leave room for improvement or substitution.

While the colloidal palladium catalyst has given good service, it has many shortcomings which are becoming more and more pronounced as the quality of manufactured printed circuit boards increases. In recent years, along with the reduction in sizes and an increase in performance of electronic devices, the packaging density of electronic circuits has become higher and subsequently required to be defect free after electroless plating. As a result of greater demands on reliability alternative catalyst compositions are required. The stability of the colloidal palladium catalyst is also a concern. As mentioned above, the palladium/tin colloid is stabilized by a layer of tin(II) ions and its counter-ions can prevent palladium from aggregating. The tin(II) ions easily oxidize to tin(IV) and thus the colloid cannot maintain its colloidal structure. This oxidation is promoted by increases in temperature and agitation. If the tin(II) concentration is allowed to fall close to zero, then palladium particles can grow in size, agglomerate, and precipitate.

Ionic catalysts have several advantages over the colloidal catalysts currently employed. First, ionic catalysts are more resistant toward oxidizing environments due to the absence of tin(II) ions and because the catalyst ions are already in an oxidized state. Additionally, ionic catalysts can penetrate deep into every recess of a substrate leading to uniform coverage of rough features. Lastly, ionic complexes deposit less catalyst material, and as such, provide the reduced residual conductivity necessary for fine line technology and lower catalyst consumption.

Ionic silver catalysts would be advantageous to use because of the much lower cost of silver relative to palladium. However, in contrast to palladium, silver catalysts suffer from low catalyst activity: longer plating initiation times and slower electroless deposition rates; and ionic silver rapidly immersion plates on copper leading to interconnect defects. The most commonly encountered form of ionic silver catalysts are based on tin(II)/silver(I) activation. In these systems, a substrate is first activated with strong acid followed by tin(II) and then silver(I). Widespread adoption of tin(II)/silver(I) catalyst systems have been thwarted by immersion plating, the strongly acidic etches necessary for tin(II) adsorption and industrial trends favoring alternatives to tin(II). Accordingly, there is a need for an improved method of electroless plating metal with ionic silver catalysts.

SUMMARY OF THE INVENTION

A method of electroless metal plating includes: providing a substrate including dielectric material and a plurality of features; applying an alkaline solution including permanganate and one or more complexing anions to the substrate including the dielectric material and the plurality of features; applying a solution including one or more monomers, one or more oligomers, one or more conductive polymers or mixtures thereof to the substrate including the dielectric material and the plurality of features to form a conductive polymer coating on the dielectric and in the plurality of features; applying a tin-free ionic catalyst including silver ions to the substrate including the dielectric material and in the plurality of features to reduce the silver ions to silver metal; and electroless plating metal on the dielectric material and in the plurality of features of the substrate.

The present invention enables a more active ionic silver catalyst without the use of tin ions. In addition, the ionic silver catalysts are more resistant toward oxidizing environments due to the absence of tin(II) ions and the catalyst silver ions are already in an oxidized state. The tin-free ionic silver catalysts can penetrate deep into every recess of a substrate leading to uniform coverage of rough features and ionic silver complexes deposit less catalyst material, thus provide the reduced residual conductivity necessary for fine line technology and lower catalyst consumption. The tin-free ionic silver catalysts also eliminate or at least reduce the need for the much higher cost palladium ions used in conventional palladium catalysts. The method of the present invention also inhibits unwanted silver immersion plating on metal-clad portions of metal-clad substrates while enabling metal plating of the features of the metal-clad substrate such as through-holes and vias. Inhibition of immersion silver plating on the metal-clad portions of the substrate prevents defect formation in the metal-clad substrate during electroless metal plating.

DETAILED DESCRIPTION OF THE INVENTION

As used throughout this specification, the abbreviations given below have the following meanings, unless the context clearly indicates otherwise: g=gram; mg=milligram; mL=milliliter; L=liter; cm=centimeter; 2.54 cm per inch; m=meter; mm=millimeter; μm=micron; ppm=parts per million=mg/L; M=molar; ° C.=degrees Centigrade;

g/L=grams per liter; DI=deionized; Ag=silver; Mo=molybdenum; $AgNO_3$=silver nitrate; $NaMnO_4$=sodium permanganate; $NaH_2PO_4$=sodium dihydrogen phosphate; $Na_2MoO_4$=sodium molybdate; $H_2SO_4$=sulfuric acid; NaOH=sodium hydroxide; Pd=palladium; $Pd(NO_3)_2$=palladium nitrate; EO/PO=ethylene oxide/propylene oxide; wt %=percent by weight; $T_g$=glass transition temperature; and SY-1141=Shengyi sourced laminate 1141.

The term "electron donating group" means an atom or functional group that donates some of its electron density into a conjugated π system via resonance or inductive electron withdrawal, thus making the π system more nucleophilic. The term "feature" means through-hole or via. The term "printed circuit board" is synonymous with "printed wiring board". The term "ligand" means an atom or molecule which attaches to a metal ion by coordinate bonding to form a coordination entity, such atoms or molecules may have available electron pairs which are neutral or negatively charged and attach to a metal ion. The term "equivalents" means molar equivalents. The terms "plating" and "deposition" are used interchangeably throughout this specification. The term "monomer" means a molecule that can bind to another molecule to form a polymer. The term "oligomer" means a molecule having a few monomer units such as two, three or four monomers that can bind to another molecule or oligomer to form a polymer. The term "a" and "an" refer to the singular and the plural. Unless specified all solutions are aqueous based, thus they include water as solvent. All amounts are percent by weight, unless otherwise noted. All numerical ranges are inclusive and combinable in any order except where it is logical that such numerical ranges are constrained to add up to 100%.

The present invention is directed to electroless metal plating of substrates of dielectric materials containing features such as through-holes and vias using a silver ion containing catalyst in combination with a conductive polymer which provides high catalytic activity and inhibits silver immersion plating. The substrates can be metal-clad or unclad. Preferably, the substrate to be electroless metal plated is a metal-clad substrate with dielectric material and a plurality of features such as through-holes or vias or combinations thereof. The metal cladding is preferably copper or copper alloy. The substrate is preferably a printed circuit board. The substrate is rinsed with water and cleaned and degreased using conventional cleaning compositions such as aqueous acid sodium persulfate solutions. Cleaning is optionally followed by desmearing the walls of any through-hole in the substrate. Prepping or softening the dielectric or desmearing of the through-holes can optionally begin with application of a solvent swell.

Conventional solvent swells can be used. The specific type can vary depending on the type of dielectric material. Minor experimentation may be done to determine which solvent swell is suitable for a particular dielectric material. The $T_g$ of the dielectric often determines the type of solvent swell to be used. Solvent swells include, but are not limited to glycol ethers and their associated ether acetates, phenoxyethanol and 1-methyl-2-pyrrolidone. Conventional amounts of glycol ethers and their associated ether acetates can be used. Examples of commercially available solvent swells are CIRCUPOSIT™ Hole Prep 3303 and CIRCUPOSIT™ Hole Prep 4120 solutions (available from Dow Advanced Materials).

Optionally, before, during or after application of the solvent swell to the substrate, the substrate can be treated with a conditioner. Conventional conditioners can be used. Such conditioners include, but are not limited to, one or more cationic surfactants, non-ionic surfactants, complexing agents and pH adjusters or buffers. Examples of commercially available acid conditioners are CIRCUPOSIT™ Conditioners 3320A and 3327 solutions (available from Dow Advanced Materials). Suitable alkaline conditioners include, but are not limited to aqueous alkaline surfactant solutions containing one or more quaternary amines, polyamines and aliphatic amines. Examples of other conditioners are ethanolamine, triethanolamine, diethanolamine and poly(vinylimidazole). Examples of commercially available alkaline surfactants are CIRCUPOSIT™ Conditioner 231, 3325, 813 and 860 formulations. Optionally, the substrate and features are rinsed with water.

Optionally, after solvent swell and conditioning, a microetch may be applied to the features of the substrate. Conventional micro-etching compositions can be used. Microetches include, but are not limited to, 60 g/L to 120 g/L sodium persulfate or sodium or potassium oxymonopersulfate and sulfuric acid (2%) mixture, or generic sulfuric acid/hydrogen peroxide. Examples of commercially available micro-etching compositions are CIRCUPOSIT™ Microetch 3330 Etch solution and PREPOSIT™ 748 Etch solution both available from Dow Advanced Materials. Optionally, the substrate is rinsed with water. Optionally, after micro-etching a conditioner can be applied to the substrate. The types of conditioners are those described above. Optionally, the substrate is rinsed with water.

The substrate and features are then treated with an aqueous alkaline permanganate solution containing one or more sources of water soluble permanganate. The aqueous permanganate enables such steps as desmear and micro-etching to be excluded from the method of the present invention, thus enabling a more rapid electroless plating method than many conventional electroless plating processes. Accordingly, desmear and micro-etching are optional steps which are preferably excluded from the present invention. Sources of water soluble permanganate include, but are not limited to sodium and potassium permanganate, copper permanganate, calcium permanganate, lithium permanganate, magnesium permanganate and ammonium permanganate. Preferably the source of water soluble permanganate is sodium and potassium permanganate. The pH of the aqueous alkaline permanganate solution is greater than 7. Preferably the pH is from 11 to 14, more preferably from 11 to 12. The temperature of the aqueous alkaline solution is from 30° C. to 95° C., preferably from 60° C. to 90° C. Permanganate is included in the aqueous alkaline solution in amounts of 20 g/L to 100 g/L, preferably 30 g/L to 80 g/L, more preferably 40 g/L to 60 g/L.

The aqueous alkaline permanganate solution preferably includes one or more complexing anions. Such anions form metal complexes with metal ions on metal cladding on substrates. Anions include, but are not limited to phosphate anions such as phosphate, hydrogen phosphate, dihydrogen phosphate, polyphosphates such as pyrophosphate and higher polyphosphates, molybdate anions, hydroxide anions, orthovanadate anions, metavanadaate anions, arsenate anions, borate anions, tetraborate anions, antimonite anions, tungstate anions, zirconate anions, hexafluorozirconate anions and chromate anions, such as trichromates and tetrachromates. Such anions are included as the water soluble alkali metal salts such as sodium, potassium and lithium salts, salts of magnesium, calcium, cesium and rubidium. Such salts include, but are not limited to, phosphates: sodium phosphate, potassium phosphate, sodium hydrogen phosphate, potassium hydrogen phosphate, sodium dihydrogen phosphate, potassium dihydrogen phosphate, sodium pyrophosphate, potassium pyrophosphate, sodium poly(phosphate) and potassium poly(phosphate); molybdates: sodium molybdate, potassium molybdate and hydrated diammonium dimolybdate; hydroxides: sodium hydroxide, potassium hydroxide, ammonium hydroxide; chromates: potassium chromate, sodium chromate, calcium chromate, potassium dichromate, sodium dichromate; and vanadates: sodium orthovanadate, sodium metavanadate. Preferably, the complexing anions are phosphates and molybdates. More preferably the complexing anions are phosphates. Most preferably the complexing anions are hydrogen phosphates such as hydrogen phosphate, dihydrogen phosphate and mixtures thereof. Water soluble salts which provide the complexing anions are added in amounts of 0.1 g/L to 100 g/L, preferably 10 g/L to 80 g/L, more preferably from 30 g/L to 70 g/L. The aqueous alkaline solution is applied to the substrate for 1 minute to 20 minutes, preferably from 5 minutes to 15 minutes, more preferably from 8 minutes to 12 minutes. Optionally the substrate is rinsed with water.

It is preferred, prior to application of the aqueous alkaline permanganate solution, that the substrate and features are treated with one or more conditioners as described above. In contrast to the conventional use of conditioners in plating features such as through-holes to promote catalyst adsorption, the function of conditioners in the present invention is to provide reducing equivalents for permanganate in order to promote the deposition of manganese oxide on regions of the dielectric such as glass fibers where manganese deposition is inefficient.

After application of the aqueous alkaline permanganate solution to the substrate, an aqueous solution containing one or more of monomers, oligomers and conductive polymers is applied to the substrate. The monomers and oligomers have π conjugation. The aqueous solution can have a pH of 2 to 7, preferably from 5 to 7, more preferably the pH is from 6 to 7. The aqueous solution including one or more of monomers, oligomers and conductive polymers is applied to the substrate at room temperature for 30 seconds to 5 minutes, preferably from 30 seconds to 2 minutes.

Upon application of the aqueous solution containing one or more of the monomers and oligomers to the substrate treated with the permanganate and preferably with the complexing anions, the monomers, oligomers or mixtures thereof polymerize on the dielectric material of the substrate to form a conductive polymer coating. The polymerization process occurs at room temperature under ambient conditions without any direct application of electromagnetic energy to the substrate such as UV light or other artificial light or applied heat. If the substrate is a metal-clad substrate such as a copper-clad substrate, polymerization occurs substantially on the dielectric portion of the substrate including on walls of through-holes and vias with none or negligible polymerization on the metal-clad portions. While not being bound by theory, when the aqueous solution is applied to the metal-clad substrate, the complexing anions complex with metal on the substrate to form a coating on the metal which inhibits permanganate from substantially depositing on the metal-cladding, thus substantial polymerization does not occur on the metal-clad portions of the substrate. When the aqueous solution includes one or more conductive polymers, the conductive polymers deposit on the portions of the substrate coated with the permanganate to form a conductive polymer coating. Optionally the substrate is rinsed with water before the next step of the method.

Monomers with π conjugation include, but are not limited to pyrroles and pyrrole derivatives such as n-methylpyrrole and 3,4-ethylenedioxypyrrole, thiophenes and thiophene derivatives such as 3,4-ethylenedioxythiophene and 2,3-dihydrothioeno[3,4-b][1,4]dioxine-2-carboxylic acid, furans and furan derivatives such as 3-methylfuran and furan-3-methanol, aniline and aniline derivatives such as substituted anilines such as o-anisidne and o-toluidine, N-substituted anilines, sulfonated and carboxylated anilines such as aniline-2-sulfonic acid, dopamine, selenophene, thioethers such as 3,4-ethylenedithiophene and oligomers of the monomers.

Conductive polymers include, but are not limited to poly(aniline) and poly(3,4-ethylenedioxythiophene) polystyrene sulfonate.

Such monomers, oligomers and conductive polymers disclosed above are included in the aqueous solution in amounts of 0.1 g/L to 100 g/L, preferably from 0.5 g/L to 50 g/L, more preferably from 1 g/L to 20 g/L.

The aqueous solution containing the monomers, oligomers, conductive polymers or mixtures thereof includes one or more acids. The acids can be organic or inorganic acids or mixtures thereof. Such organic acids include, but are not limited to alky sulfonic acids such as methane sulfonic acid, ethane sulfonic acid and propane sulfonic acid; aryl sulfonic acids such as benzene sulfonic acid and p-toluene sulfonic acid; and disulfonic acids such as ethane disulfonic acid and propane disulfonic acid, polymeric sulfonic acids such as polystyrene sulfonic acid, carbon based acids such as citric acid, oxalic acid, glycolic acid. Inorganic acids include but are not limited to amino sulfonic acids such as sulfamic acid and taurine, sulfuric acid and phosphoric acid. Preferably the acids are chosen from aryl sulfonic acids such as benzene sulfonic acid and p-toluene sulfonic acid and polystyrene sulfonic acids. The acids are included to solubilize the monomer, oligomer and conductive polymer particles. Preferably the acids are included in amounts of 5 g/L to 40 g/L, more preferably from 10 g/L to 30 g/L. Most preferably, the acids are included in amounts of 1-4 molar equivalents of the monomer, oligomer and conductive polymer concentrations. The pH of the solution may be adjusted with inorganic bases such as sodium and potassium hydroxide or conjugate bases of the acids.

Optionally, the aqueous solution containing the monomers, oligomers, conductive polymers or mixtures thereof includes one or more surfactants. Such surfactants include, but are not limited to cationic surfactants, anionic surfactants, amphoteric surfactants and non-ionic surfactants. Preferably non-ionic surfactants are included in the aqueous monomer solutions. Surfactants are included in amounts of 0.05 g/L to 10 g/L.

Non-ionic surfactants include, but are not limited to alkyl phenoxy polyethoxyethanols, polyoxyethylene polymers having from 20 to 150 repeating units and block copolymers of polyoxyethylene and polyoxypropylene.

Cationic surfactants include, but are not limited to tetraalkylammonium halides, alkyltrimethylammonium halides, hydroxyethyl alkyl imidazoline, alkylbenzalkonium halides, alkylamine acetates, alkylamine oleates and alkylaminoethyl glycine.

Anionic surfactants include, but are not limited to alkylbenzenesulfonates, alkyl or alkoxy naphthalene sulfonates, alkyldiphenyl ether sulfonates, alkyl ether sulfonates, alkylsulfuric esters, polyoxyethylene alkyl ether sulfuric esters, polyoxyethylene alkyl phenol ether sulfuric esters, higher alcohol phosphoric monoesters, polyoxyalkylene alkyl ether phosphoric acids (phosphates) and alkyl sulfosuccinates.

Amphoteric surfactants include, but are not limited to 2-alkyl-N-carboxymethyl or ethyl-N-hydroxyethyl or methyl imidazolium betaines, 2-alkyl-N-carboxymethyl or ethyl-N-carboxymethyloxyethyl imidazolium betaines, dimethylalkyl betains, N-alkyl-β-aminopropionic acids or salts thereof and fatty acid amidopropyl dimethylaminoacetic acid betaines.

After polymerization an aqueous tin-free ionic silver catalyst is applied to the substrate containing the conductive polymer. The silver ions are reduced to silver metal by the conductive polymers on the dielectric material including walls of through-holes and vias of the substrate. When the substrate is metal-clad, substantially no silver ions are reduced on the metal-cladding since there is substantially no polymer on the metal-clad portions of the substrate. While not being bound by theory, limiting silver ion reduction to silver metal on the conductive polymer coated dielectric material prevents undesired immersion silver plating on the metal-clad portions. In addition, the complex anion coated metal-cladding is also believed to contribute to inhibition of immersion silver plating. The ionic catalyst is applied to a substrate at room temperature. Application is done for 1 minute to 5 minutes. Preferably, the time period does not exceed 5 minutes because undesired silver immersion plating may occur. The substrate is then rinsed with DI water to reduce drag-in of the catalyst solution into the electroless bath.

One or more sources of silver ions are included in the aqueous tin-free silver ionic catalyst. Preferably the one or more sources of silver ions are water-soluble silver salts; however water-dispersible silver salts can be used sparingly. Such silver salts include, but are not limited to silver nitrate, silver acetate, silver trifluoroacetate, silver tosylate, silver triflate, silver fluoride, silver oxide, silver sodium thiosulfate and silver potassium cyanide. Silver salts are included in the aqueous tin-free ionic catalysts in amounts to provide silver ion concentrations of 6 mg/L to 6 g/L, preferably from 30 mg/L to 3 g/L, more preferably 130 mg/L to 1.3 g/L.

The pH of the aqueous ionic catalyst is greater than 5. The pH can be adjusted with salts such as sodium tetraborate, sodium carbonate or alkali metal hydroxides such as potassium or sodium hydroxide or mixtures thereof. Acids which can be used to adjust the pH include, but are not limited to sulfuric acid and nitric acid; however, hydrochloric acid is excluded for adjusting the pH range. Preferably, the pH range of the aqueous ionic silver catalyst solution is from 6 to 9, more preferably from 6 to 7.

Preferably the aqueous ionic catalyst includes one or more ligand forming agents which form ligands with the silver ions by coordination bonding to form a coordination entity. While not being bound by theory, the ligand forming agents may contribute to inhibiting immersion silver plating. Such ligand forming agents include, but are not limited to amines, organic heterocyclic compounds, amino acids, thiols, thioethers, ethers, alcohols, amides, imines, organic acids, acetylene and esters. Preferably the ligand forming agents are chosen from organic heterocyclic compounds, amino acids, thio ethers and organic acids with lone pair electrons. More preferably the ligand forming agents are chosen from organic heterocyclic compounds, amino acids and organic acids with lone pair electrons. Most preferably the ligand forming agents are chosen from organic heterocyclic compounds with lone pair electrons. One or more ligand forming agents are included in the aqueous ionic catalyst such that the molar equivalents of the one or more ligands to silver ions are preferably from 1 molar equivalent to 10 molar equivalents, more preferably from 1 molar equivalent to 6 molar equivalent. Such molar equivalent ratios assist in achieving the desired silver ion reduction potentials.

Amines include, but are not limited to alkyl-amines such as secondary amines and tertiary amines such as triethylamine, N,N-diisopropylethylamine.

Organic heterocyclic compounds with lone pair electrons include, but are not limited to pyrimidine derivatives, pyrazine derivatives, and pyridine derivatives. Pyrimidine derivatives include, but are not limited to uracil, thymine, 2-aminopyrimidine, 6-hydroxy-2,4-dimethylpyrimidine, 6-methyluracil, 2-hydroxypyrimidine, 4,6-dichloropyrimidine, 2,4-dimethoxypyrimidine, 2-amino-4,6-dimethylpyrimidine, 2-hydroxy-4,6-dimethylpyrimidine and 6-methylisocytosine. Pyrazine derivatives include, but are not limited to 2,6-dimethylpyrazine, 2,3-dimethylpyrazine, 2,5-dimethylpyrazine, 2,3,5-trimethylpyraizine, 2-acetylpyrazine, aminopyrazine, ethylpyrazine, methoxypyrazine, and 2-(2'-hydroxyethyl)pyrazine. Pyridine derivatives include, but are not limited to poly(vinylpyridine).

Amino acids include but are not limited to the α-amino acid such as methionine, glycine, alanine, valine, leucine, isoleucine, lysine, arginine, histidine, aspartic acid, asparagine, glutamine, phenylalanine, tyrosine, tryptophan, cysteine and serine.

Thiols include, but are not limited to thiophenol, thiosalicylic acid, 4-mercaptophenylacetic acid and 2-mercaptopropionic acid.

Thioethers include, but are not limited to 2,2'-(ethylenedithio)diethanol

Ethers include, but are not limited to ethylene glycol dimethyl ether, propylene glycol dimethylether, poly(ethyleneoxide), poly(propyleneoxide), co-polymers of EO/PO and crown ethers.

Alcohols include, but are not limited to ethylene glycol, propylene glycol, iso-propanol, propanol, butanol, ethanol, methanol, phenol.

Amides include, but are not limited to 2-pyrrolidone, polyvinylpyrrolidone and N,N-dimethylacetamide.

Organic acids include, but are not limited to picolinic acid nicotinic acid, acetic acid, propionic acid, quinaldic acid, barbituric acid and orotic acid.

Esters include, but are not limited to methyl isonicotinate, γ-butyrolactone.

Optionally, one or more additional noble metal ions can be included with the silver ions in the catalyst. Such noble metal ions include palladium, platinum, ruthenium, rhodium and iridium. Preferably, the metal ions are palladium ions. While not being bound by theory, the ionic species of these metals, as with silver ions, form a coordination entity with one or more of the ligand forming agents at potentials more positive than the reduction potentials of the conductive polymers where the metal ions are reduced to their metallic oxidation states. One or more ligand forming agents are included in the aqueous ionic catalyst such that the molar equivalents of the one or more ligands to noble metal ions are preferably from 1 equivalent to 10 equivalents.

Palladium salts include, but are not limited to palladium triflate, palladium tosylate, palladium trifluoroacetate, palladium chloride, palladium acetate, palladium potassium chloride, palladium sodium chloride, sodium tetrachloropalladate, palladium sulfate and palladium nitrate. Palladium salts are included in the aqueous ionic catalyst in amounts to provide palladium ions at concentrations of 0.01 g/L to 10 g/L, preferably from 0.05 g/L to 0.5 g/L.

Platinum salts include, but are not limited to platinum chloride and platinum sulfate. Platinum salts are included in the aqueous ionic catalyst to provide platinum ion concentrations of 0.01 g/L to 10 g/L, preferably from 0.05 g/L to 0.5 g/L.

Ruthenium salts include, but are not limited to ruthenium trichloride and ammoniated ruthenium oxychloride. Ruthenium salts are included in the aqueous catalyst in amounts to provide ruthenium ions at concentrations of 0.01 g/L to 10 g/L, preferably from 0.2 g/L to 2 g/L.

Rhodium salts include, but are not limited to hydrated rhodium trichloride, rhodium acetate. Rhodium salts are included in amounts to provide rhodium ions in amounts of 0.01 g/L to 10 g/L, preferably from 0.2 g/L to 2 g/L.

Iridium salts include, but are not limited to hydrated iridium trichloride, iridium tribromide. Iridium salts are included in amounts to provide iridium ions in amounts of 0.01 g/L to 10 g/L, preferably from 0.2 g/L to 2 g/L.

The aqueous ionic catalysts may be used to electrolessly metal plate various dielectric containing substrates such as metal-clad and unclad substrates such as printed circuit boards. Such metal-clad and unclad printed circuit boards may include thermosetting resins, thermoplastic resins and combinations thereof, including fiber, such as fiberglass, and impregnated embodiments of the foregoing. Preferably the substrate is a metal-clad printed circuit or wiring board.

Thermoplastic resins include, but are not limited to acetal resins, acrylics, such as methyl acrylate, cellulosic resins, such as ethyl acetate, cellulose propionate, cellulose acetate butyrate and cellulose nitrate, polyethers, nylon, polyethylene, polystyrene, styrene blends, such as acrylonitrile styrene and copolymers and acrylonitrile-butadiene styrene copolymers, polycarbonates, polychlorotrifluoroethylene, and vinylpolymers and copolymers, such as vinyl acetate, vinyl alcohol, vinyl butyral, vinyl chloride, vinyl chloride-acetate copolymer, vinylidene chloride and vinyl formal.

Thermosetting resins include, but are not limited to allyl phthalate, furane, melamine-formaldehyde, phenol-formaldehyde and phenol-furfural copolymers, alone or compounded with butadiene acrylonitrile copolymers or acrylonitrile-butadiene-styrene copolymers, polyacrylic esters, silicones, urea formaldehydes, epoxy resins, allyl resins, glyceryl phthalates and polyesters.

The catalysts may be used to plate substrates with both low and high $T_g$ resins. Low $T_g$ resins have a $T_g$ below 160° C. and high $T_g$ resins have a $T_g$ of 160° C. and above. Typically high $T_g$ resins have a $T_g$ of 160° C. to 280° C. or such as from 170° C. to 240° C. High $T_g$ polymer resins include, but are not limited to, polytetrafluoroethylene (PTFE) and polytetrafluoroethylene blends. Such blends include, for example, PTFE with polypheneylene oxides and cyanate esters. Other classes of polymer resins which include resins with a high $T_g$ include, but are not limited to, epoxy resins, such as difunctional and multifunctional epoxy resins, bimaleimide/triazine and epoxy resins (BT epoxy), epoxy/polyphenylene oxide resins, acrylonitrile butadiene-styrene, polycarbonates (PC), polyphenylene oxides (PPO), polypheneylene ethers (PPE), polyphenylene sulfides (PPS), polysulfones (PS), polyamides, polyesters such as polyethyleneterephthalate (PET) and polybutyleneterephthalate (PBT), polyetherketones (PEEK), liquid crystal polymers, polyurethanes, polyetherimides, epoxies and composites thereof.

The aqueous ionic catalysts may be used to electroless deposit metals on walls of through-holes and vias of printed circuit boards. The catalysts may be used in both horizontal and vertical processes of manufacturing printed circuit boards.

The aqueous ionic catalysts may be used with conventional aqueous alkaline electroless metal plating baths. While it is envisioned that the catalysts may be used to electrolessly deposit any metal which may be electrolessly plated, preferably, the metal is chosen from copper, copper alloys, nickel or nickel alloys. More preferably the metal is chosen from copper and copper alloys, most preferably copper is the metal plated. An example of a commercially available electroless copper plating bath is CIRCUPOSIT™ 880 Electroless Copper bath (available from Dow Advanced Materials, Marlborough, Mass.).

Typically sources of copper ions include, but are not limited to water soluble halides, nitrates, acetates, sulfates and other organic and inorganic salts of copper. Mixtures of one or more of such copper salts may be used to provide copper ions. Examples include copper sulfate, such as copper sulfate pentahydrate, copper chloride, copper nitrate, copper hydroxide and copper sulfamate. Conventional amounts of copper salts may be used in the compositions. In general copper ion concentrations in the composition may range from 0.5 g/L to 30 g/L.

One or more alloying metals also may be included in the electroless compositions. Such alloying metals include, but are not limited to nickel and tin. Examples of copper alloys include copper/nickel and copper/tin. Typically the copper alloy is copper/nickel.

Sources of nickel ions for nickel and nickel alloy electroless baths may include one or more conventional water soluble salts of nickel. Sources of nickel ions include, but are not limited to, nickel sulfates and nickel halides. Sources of nickel ions may be included in the electroless alloying compositions in conventional amounts. Typically sources of nickel ions are included in amounts of 0.5 g/L to 10 g/L.

The substrate and walls of the through-holes and vias are then electroless sly plated with metal, such as copper, copper alloy, nickel or nickel alloy using an electroless bath. Preferably copper is plated on the walls of the through-holes and vias. Plating times and temperatures may be conventional. Typically metal deposition is done at temperatures of room temperature to 80° C., more typically from 30° C. to 60° C. The substrate may be immersed in the electroless plating bath or the electroless bath may be sprayed onto the substrate. Typically, electroless plating may be done for 1 minute to 30 minutes; however, plating times may vary depending on the thickness of the metal desired. Typically the pH of the plating solution is 8 and higher, preferably the pH is from 9 to 13.

Optionally anti-tarnish may be applied to the metal. Conventional anti-tarnish compositions may be used. An example of anti-tarnish is ANTI TARNISH™ 7130 solution (available from Dow Advanced Materials). The substrate may optionally be rinsed with water and then the boards may be dried.

Further processing may include conventional processing by photoimaging, etching and stripping and further metal deposition on the substrates such as electrolytic metal deposition of, for example, copper, copper alloys, tin and tin alloys.

The following examples are not intended to limit the scope of the invention but to further illustrate the invention.

Example 1 (Comparative)

A 1×0.5 inch double-sided SY-1141 copper clad FR4 laminate was dipped in the following solutions with DI water rinses for 30 seconds between steps:

1) 80 mL of an aqueous cleaning solution of sodium persulfate 75 g/L, 1-2% $H_2SO_4$ for 1 minute at room temperature; and
2) 80 mL of an aqueous catalyst of $AgNO_3$ 2 g/L at pH=6-7 for 30 seconds at room temperature.

Rapid silver immersion plating on the copper clad portion of the laminate was observed within the 30 second time period in which the copper clad laminate was immersed in the catalyst solution. Substantially all of the copper cladding was coated with silver. There was no visible pink copper cladding.

Example 2 (Comparative)

Two 1×0.5 inch double-sided SY-1141 copper clad FR4 laminates were dipped in the following solutions with DI water rinses for 30 seconds between steps:

1) 80 mL of an aqueous cleaning solution of sodium persulfate 75 g/L, 1-2% $H_2SO_4$ for 1 minute at room temperature;
2) 80 mL of an aqueous ionic silver catalyst of $AgNO_3$ 2 g/L, 2,6-dimethylpyrazine 2.54 g/L at pH=6-7 for 30 seconds for one laminate and 5 minutes for the second laminate at room temperature. The molar equivalents of the 2,6-dimethylpyrazine ligand to the silver ions was 2:1.

Although there was substantial immersion silver plating on both laminates, each laminate had some visible pink copper cladding. The addition of the ligand, 2,6-dimethylpyraizine, to the ionic catalyst provided some inhibition of silver immersion plating as compared to the ionic silver catalyst of Example 1 above where no ligand was included in the ionic catalyst.

Example 3

A 1×0.5 inch double-sided SY-1141 copper clad FR4 laminate was dipped in the following solutions with DI water rinses for 30 seconds between steps:

1) 80 mL of an aqueous cleaning solution of sodium persulfate 75 g/L, 1-2% $H_2SO_4$ for 1 minute at room temperature;
2) 200 mL of an aqueous alkaline solution of permanganate and complexing anion solution: $NaMnO_4$ 60 g/L, $NaH_2PO_4$ 10 g/L, pH=9.3 for 1 minute at 60° C.; and
3) 80 mL of an aqueous ionic silver catalyst of $AgNO_3$ 2 g/L, 2,6-dimethylpyrazine 2.54 g/L at pH=6-7 for 5 minutes at room temperature. The molar equivalents of the 2,6-dimethylpyrazine ligand to the silver ions was 2:1.

Each laminate was then rinsed with DI water and examined for any traces of silver immersion plating. In contrast to the copper-clad laminate in Example 1 above, no silver immersion plating was observed on the laminate including the copper clad portions of the copper clad FR4 laminate despite 10 times the immersion time in silver of Example 1. The combination of the complexing anion, $H_2PO_4^-$ and the ligand, 2,6-dimethylpyrazine, appeared to inhibit silver immersion plating on the copper-clad portion of the double-sided copper clad FR4 laminate.

Example 4

A double-sided SY-1141 copper clad FR4 laminate and a bare SY-1141 FR4 laminate stripped of copper foil were dipped in the following solutions with DI water rinses for 30 seconds between steps:

1) 80 mL of an aqueous cleaning solution of sodium persulfate 75 g/L, 1-2% $H_2SO_4$ for 1 minute at room temperature;
2) 200 mL of an aqueous alkaline permanganate and complexing anion solution of $NaMnO_4$ 60 g/L, $NaH_2PO_4$ 50 g/L, pH=12.5, for 10 minutes at 80° C.;
3) 80 mL of a monomer solution: pyrrole 5 g/L, p-toluenesulfonic acid 28.8 g/L, pH=7, for 1 minutes at room temperature;
4) 80 mL of an aqueous ionic silver catalyst solution: 0.25 g/L $AgNO_3$ with 0.79 g/L of 2,6-dimethylpyrazine, pH=8.6, for 2 minutes at room temperature and the ligand to silver ions molar equivalents was 5:1; and
5) 80 mL of an Electroless copper plating with CIRCUPOSIT™ 880 electroless copper bath at 40° C. for 10 minutes.

Both laminates had bright and uniform copper deposits on the dielectric. There was no observable silver immersion plating on the copper clad portion of the double-sided copper clad FR4 laminate.

Examples 5-7

Three double-sided SY-1141 copper clad FR4 laminates and three bare SY-1141 FR4 laminates stripped of copper foil were dipped in the following solutions with DI water rinses for 30 seconds between steps:

1) 80 mL of an aqueous cleaning solution of sodium persulfate 75 g/L, 1-2% $H_2SO_4$ for 1 minute at room temperature;
2) 200 mL of an aqueous alkaline permanganate and complexing anion solution: $NaMnO_4$ 60 g/L, $NaH_2PO_4$ 50 g/L, pH=11, for 10 minutes at 80° C.;
3) 80 mL of a monomer solution: 3,4-ethylenedioxythiophene 5 g/L, p-toluenesulfonic acid 13.4 g/L, Sodium dodecylbenzenesulfonate 10 g/L, TERGITOL™ L-61 surfactant 5 g/L, pH=7, for 1 minute at room temperature;
4) 80 mL of an aqueous ionic silver catalyst: Ligand (See Table) and $AgNO_3$ 2 g/L, pH 6-7, for 2 minutes at room temperature; and
4) 80 mL of an electroless copper plating with CIRCUPOSIT™ 880 electroless copper bath at 50° C. for 10 or 15 minutes.

| EXAMPLE | LIGAND | AMOUNT |
|---|---|---|
| 5 | Methionine | 1.76 g/L |
| 6 | 2,2'-(ethylenedithiol)diethanol | 2.15 g/L |
| 7 | 2,6-dimethylpyrazine | 6.4 g/L |

The molar equivalents of ligand to silver ions was 1:1, 1:1 and 5:1 for Examples 5, 6 and 7, respectively. The laminates electroless plated with copper in Examples 5 and 6 were plated for 15 minutes and the laminates plated in Example 7 were plated for 10 minutes. After plating the laminates were rinsed with DI water and analyzed for copper deposit quality and signs of any silver immersion plating. All the laminates had bright and uniform copper deposits. There was no observable silver immersion plating on the copper cladding of any of the copper clad laminates.

Example 8

A double-sided SY-1141 copper clad FR4 laminate and a bare SY-1141 FR4 laminate stripped of copper foil were dipped in the following solutions with DI water rinses for 30 seconds between steps:

1) 80 mL of an aqueous cleaning solution of sodium persulfate 75 g/L, 1-2% $H_2SO_4$ for 1 minute at room temperature;
2) 200 mL of an aqueous alkaline permanganate and complexing anion solution: $NaMnO_4$ 60 g/L, $NaH_2PO_4$ 50 g/L, pH=11, for 10 minutes at 80° C.;
3) 80 mL of a monomer solution: pyrrole 5 g/L, p-toluenesulfonic acid 28.8 g/L, pH=7, for 1 minute at room temperature;
4) 80 mL of an aqueous ionic silver catalyst: picolinic acid 0.36 g/L and $AgNO_3$ 0.5 g/L, pH 6-7, for 2 minutes at room temperature and the molar equivalents of ligand to silver ions was 1:1; and
5) 80 mL of an electroless copper plating with CIRCUPOSIT™ 880 electroless copper bath at 50° C. for 10 minutes.

Both laminates had bright and uniform copper deposits. There was no observable silver immersion plating on the copper cladding.

Example 9

A double-sided SY-1141 copper clad FR4 laminate and a bare SY-1141 FR4 laminate stripped of copper foil were dipped in the following solutions with DI water rinses for 30 seconds between steps:

1) 80 mL of an aqueous cleaning solution of sodium persulfate 75 g/L, 1-2% $H_2SO_4$ for 1 minute at room temperature;
2) 200 mL of an aqueous alkaline permanganate and complexing anion solution: $NaMnO_4$ 60 g/L, $NaH_2PO_4$ 50 g/L, pH=11, for 10 minutes at 80° C.;
3) 80 mL of a monomer solution: pyrrole 5 g/L, p-toluenesulfonic acid 28.8 g/L, pH 6.5 for 1 minute at room temperature;
4) 80 mL of an aqueous ionic silver catalyst: $AgNO_3$ 0.5 g/L, picolinic Acid 0.36 g/L, pH 6.5, for 2 minutes at room temperature and the molar equivalents of ligand to silver ions was 1:1; and
5) 80 mL of an electroless copper plating with CIRCUPOSIT™ 880 electroless copper bath at 50° C. for 10 minutes.

Both laminates had bright and uniform copper deposits coating the dielectric portions of the laminates. In addition, there was no observable silver immersion plating on the copper clad parts.

Example 10

The process for treating and electroless copper plating a double-sided SY-1141 copper clad FR4 laminate and a bare SY-1141 FR4 laminate stripped of copper foil was repeated as in Example 9 above except the aqueous alkaline permanganate solution included $NaMnO_4$ 50 g/L and NaOH 48 g/L. Both laminates had bright and uniform copper deposits and there was no observable silver immersion on the copper clad portion of the double-sided FR4 laminate. The ionic silver catalyst showed good catalyst activity.

Example 11

A double-sided SY-1141 copper clad FR4 laminate and a bare FR4 laminate stripped of copper foil were dipped in the following solutions with DI water rinses for 30 seconds between steps:

1) 80 mL of an aqueous solution of sodium persulfate 75 g/L, 1-2% $H_2SO_4$ for 1 minute at room temperature;
2) 200 mL of an aqueous alkaline permanganate solution of $NaMnO_4$ 60 g/L, $Na_2MoO_4$ 50 g/L, pH=11 for 10 minutes at 80° C.;
3) 80 mL of a monomer solution: pyrrole 5 g/L, p-toluenesulfonic acid 28.8 g/L, pH 6.5 for 1 minute at room temperature;
4) 80 mL of an aqueous silver and palladium catalyst: $AgNO_3$ 0.45 g/L, $Pd(NO_3)_2$ 0.05 g/L, pH 6, for 2 minutes at room temperature;
5) 250 mL of an aqueous acid cleaner: DI water and $H_2SO_4$ until pH=3 for 1 minute at room temperature; and
6) 80 mL of an electroless copper plating using 880 electroless copper bath at 40° C. for 10 minutes.

Both laminates had bright and uniform copper deposits coating the dielectric portions of the laminates. In addition, there was no observable silver immersion plating on the copper clad parts.

Example 12

The process for treating and electroless copper plating a double-sided SY-1141 copper clad FR4 laminate and a bare SY-1141 FR4 laminate stripped of copper foil was repeated as in Example 11 above except the aqueous alkaline permanganate solution included $NaMnO_4$ 60 g/L, $Na_2MoO_4$ 50 g/L and $NaH_2PO_4$ 10 g/L.

Both laminates had bright and uniform copper deposits and there was no observable silver immersion on the copper clad portion of the double-sided FR4 laminate.

Example 13

A double-sided SY-1141 copper clad FR4 laminate and a bare SY-1141 FR4 laminate stripped of copper foil were dipped in the following solutions with DI water rinses for 30 seconds between steps:

1) 80 mL of an aqueous solution of sodium persulfate 75 g/L, 1-2% $H_2SO_4$ for 1 minute at room temperature;
2) 200 mL of an aqueous alkaline permanganate solution of $NaMnO_4$ 60 g/L, $NaH_2PO_4$ 50 g/L, pH=12.5, for 10 minutes at 80° C.;
3) 80 mL of an aqueous monomer solution of pyrrole 5 g/L, p-toluenesulfonic acid 28.8 g/L, pH=7, for 1 minutes at room temperature;
4) 80 mL of an aqueous metal catalyst containing 0.225 g/L $AgNO_3$ 0.025 g/L, $Pd(NO_3)_2$, 0.8 g/L of 2,6-dimethylpyrazine, pH 6 to 7, for 2 minutes at room temperature and the molar equivalents of the ligand to the silver ions was 5:1 and the molar equivalents of the ligand to the palladium ions was 5:1; and
5) 80 mL of an Electroless copper plating with CIRCUPOSIT™ 880 electroless copper bath at 40° C. for 10 minutes.

Both laminates had bright and uniform copper deposits and were completely plated with copper. There was no observable silver immersion on the copper clad portion of the double-sided FR4 laminate.

Example 14

A double-sided SY-1141 copper clad FR4 laminate and a bare SY-1141 FR4 laminate stripped of copper foil were dipped in the following solutions with DI water rinses for 30 seconds between steps:

1) 80 mL of an aqueous solution of sodium persulfate 75 g/L, 1-2% $H_2SO_4$ for 1 minute at room temperature;

2) 200 mL of an aqueous alkaline permanganate solution of $NaMnO_4$ 60 g/L, $Na_3PO_4$-$12H_2O$ 20 g/L, pH=12, for 10 minutes at 80° C.;
3) 80 mL of an aqueous solution of poly(3,4-ethylenedioxythiophene) polystyrene sulfonate conductive polymer at pH 11 prepared from Heraeus, Clevios™ P HC V4 concentrate by dilution of 8 ml to 80 ml and adjusting the pH with NaOH;
4) 80 mL of an aqueous metal catalyst containing 0.5 g/L $AgNO_3$, and 1.6 g/L of 2,6-dimethylpyrazine, pH 6 to 7, for 2 minutes at room temperature and the molar equivalents of the ligand to the silver ions was 5:1; and
5) 80 mL of CIRCUPOSIT™ 880 electroless copper bath at 40° C. for 10 minutes.

The dielectric of both laminates was completely plated with copper and the copper deposits were bright and uniform. There was no observable silver immersion on the copper clad portion of the double-sided FR4 laminate.

Example 15

A double-sided SY-1141 copper clad FR4 laminate and a bare SY-1141 FR4 laminate stripped of copper foil were dipped in the following solutions with DI water rinses for 30 seconds between steps:

1) 80 mL of an aqueous solution of sodium persulfate 75 g/L, 1-2% $H_2SO_4$ for 1 minute at room temperature;
2) 200 mL of an aqueous alkaline permanganate solution of $NaMnO_4$ 60 g/L, $Na_3PO_4$-$12H_2O$ 20 g/L, pH=12, for 10 minutes at 80° C.;
3) 80 mL of an aqueous solution of poly(3,4-ethylenedioxythiophene) polystyrene sulfonate conductive polymer at pH 11 prepared from Heraeus, Clevios™ P HC V4 concentrate by dilution of 8 ml to 80 ml and adjusting the pH with NaOH;
4) 80 mL of an aqueous metal catalyst containing 0.5 g/L $AgNO_3$, and 1.6 g/L of 2,6-dimethylpyrazine, pH 6 to 7, for 2 minutes at room temperature and the molar equivalents of the ligand to the silver ions was 5:1; and
5) 80 mL of CIRCUPOSIT™ 6550 electroless copper bath at 40° C. for 10 minutes.

The dielectric of both laminates was completely plated with copper and the copper deposits were bright and uniform. There was no observable silver immersion on the copper clad portion of the double-sided FR4 laminate.

Example 16

An 8 layer SY-1141 copper clad FR4 glass/epoxy laminate with drilled through-holes was dipped in the following solutions with DI water rinses for 30 seconds between steps:

1) 80 mL of an aqueous solution of sodium persulfate 75 g/L, 1-2% $H_2SO_4$ for 1 minute at room temperature;
2) 80 ml of aqueous CIRCUPOSIT™ Cleaner Conditioner 3325 at 40° C. for 2 minutes.
3) 200 mL of an aqueous alkaline permanganate solution of $NaMnO_4$ 60 g/L, $Na_3PO_4$-$12H_2O$ 20 g/L, pH=12, for 10 minutes at 80° C.;
4) 80 mL of an aqueous solution of poly(3,4-ethylenedioxythiophene) polystyrene sulfonate conductive polymer at pH 11 prepared from Heraeus, Clevios™ P HC V4 concentrate by dilution of 8 ml to 80 ml and adjusting the pH with NaOH;
5) 80 mL of an aqueous metal catalyst containing 0.5 g/L $AgNO_3$, and 1.6 g/L of 2,6-dimethylpyrazine, pH 6 to 7, for 2 minutes at room temperature and the molar equivalents of the ligand to the silver ions was 5:1; and
6) 80 mL of CIRCUPOSIT™ 880 electroless copper bath at 40° C. for 15 minutes.

There was no observable silver immersion plating on the copper clad portion of the laminate. The through-holes were cross-sectioned and a conventional backlight rating method was used to determine the amount of copper plated on the through-hole walls. The backlight was graded on a 1-5 scale. A backlight rating of 1 indicates no observable copper deposits whereas a backlight rating of 5 indicates the entire sample was copper plated. A rating between 1 and 5 indicates some copper plating. The higher the backlight rating of a sample the more copper plated on the sample. The through-holes were substantially covered with copper achieving a 4.0 rating out of 5 with full coverage on the epoxy rich regions and some voiding of the glass fibers.

Example 17

An 8 layer SY-1141 copper clad FR4 glass/epoxy laminate was dipped in the following solutions with DI water rinses for 30 seconds between steps:

1) 80 mL of an aqueous solution of sodium persulfate 75 g/L, 1-2% $H_2SO_4$ for 1 minute at room temperature;
2) 80 ml of aqueous CIRCUPOSIT™ Cleaner Conditioner 3325 at 40° C. for 2 minutes.
3) 200 mL of an aqueous alkaline permanganate solution of $NaMnO_4$ 60 g/L, $Na_3PO_4$-$12H_2O$ 20 g/L, pH=12, for 10 minutes at 80° C.;
4) 80 mL of an aqueous solution of poly(3,4-ethylenedioxythiophene) polystyrene sulfonate conductive polymer at pH 11 prepared from Heraeus, Clevios™ P HC V4 concentrate by dilution of 8 ml to 80 ml and adjusting the pH with NaOH;
5) 80 mL of an aqueous metal catalyst containing 0.5 g/L $AgNO_3$, and 1.6 g/L of 2,6-dimethylpyrazine, pH 6 to 7, for 2 minutes at room temperature and the molar equivalents of the ligand to the silver ions was 5:1; and
6) 80 mL of CIRCUPOSIT™ 6550 electroless copper bath at 40° C. for 15 minutes.

There was no observable silver immersion plating on the copper clad portion of the laminate. The through-holes were cross-sectioned and the backlight was graded on a 1-5 scale. The through-holes were substantially covered with copper achieving a 4.75 rating out of 5 with full coverage on the epoxy rich regions and sparse voiding on the tips of the glass fibers.

What is claimed is:

1. A method of electroless metal plating comprising:

a) providing a substrate comprising dielectric material and a plurality of features, wherein the plurality of features are chosen from one or more of through-holes and vias;
b) applying an alkaline solution comprising permanganate and one or more complexing anions chosen from molybdate anions, orthovanadate anions, metavanadate anions, arsenate anions, antimonite anions, tungstate anions, zirconate anions and hexafluorozirconate anions to the substrate comprising the dielectric material and the plurality of features;
c) applying a solution comprising one or more monomers, one or more oligomers, one or more conductive polymers or mixtures thereof to the substrate comprising the dielectric material and the plurality of features to form a conductive polymer coating on the dielectric material and in the plurality of features of the substrate;
d) applying a tin-free ionic catalyst comprising silver ions and one or more ligand agents to form a coordination entity with the silver ions, wherein the one or more ligand agents are chosen from organic heterocyclic compounds, thio ethers and organic acids with lone pair electrons to the substrate comprising the dielectric material and the plurality of features with the conductive polymer to reduce the silver ions to silver metal; and e) electroless plating copper or nickel on the dielectric material and in the plurality of features of the substrate comprising the conductive polymer and the silver metal.

2. The method of electroless metal plating of claim 1, wherein the one or more monomers are chosen from monomers comprising π conjugation.

3. The method of electroless metal plating of claim 2, wherein the one or more monomers comprising π conjugation are chosen from pyrrole, thiophene, 3,4-ethylenedioxythiophene, aniline, dopamine and selenophene.

4. The method of electroless plating of claim 1, wherein the tin-free ionic catalyst further comprises one or more of palladium ions, platinum ions, ruthenium ions, rhodium ions and iridium ions.

5. The method of electroless metal plating of claim 1, further comprising applying a solvent swell to the substrate comprising the dielectric materials and the plurality of features.

6. The method of electroless metal plating of claim 1, further comprising applying a conditioner to the substrate comprising the dielectric material and the plurality of features.

7. The method of electroless metal plating of claim 1, wherein the substrate comprising the dielectric material and the plurality of features further comprises metal-cladding.

8. The method of electroless metal plating of claim 7, wherein the metal-cladding is copper.

9. The method of claim 1, wherein a source of molybdate anions are chosen from one or more of sodium molybdate, potassium molybdate and hydrated diammonium dimolybdate.

10. The method of claim 1, wherein a pH of the alkaline solution is from 11 to 14.

11. The method of claim 10, wherein the pH of the alkaline solution is from 11 to 12.

12. The method of claim 1, wherein the alkaline solution further comprises one or more complexing anions chosen from phosphate anions, borate anions and tetraborate anions.

13. The method of claim 12, wherein the one or more complexing anions is chosen from phosphate anions.

14. The method of claim 13, wherein a source of the phosphate anions are chosen from one or more of phosphate, hydrogen phosphate, dihydrogen phosphate and polyphosphates.

* * * * *